United States Patent [19]

Horter

[11] 4,159,721

[45] Jul. 3, 1979

[54] SANITARY PRESSURE RELIEF DEVICE

[76] Inventor: Robert Horter, 11740 Maywood Dr., Sparta, Mich. 49345

[21] Appl. No.: 811,465

[22] Filed: Jun. 30, 1977

[51] Int. Cl. ..... F16k 43/00

[52] U.S. Cl. ..... 137/317; 285/156; 414/3

[58] Field of Search ..... 4/421, 428, DIG. 14; 15/104.05, 104.3 G, 104.3 R, 104.3 JN; 137/317, 319, 320, 321, 322, 323; 138/89; 214/1 CM, 1 R; 285/120, 156; 312/1

[56] References Cited

U.S. PATENT DOCUMENTS

| | | | |
|---|---|---|---|
| 2,241,560 | 5/1941 | Schouler | 138/89 |
| 2,451,051 | 10/1948 | Tubbs | 15/104.3 R |
| 3,009,164 | 11/1961 | Frey | 312/1 |
| 3,084,684 | 4/1963 | Saunders | 312/1 |
| 3,122,158 | 2/1964 | Grunsky | 137/317 |
| 3,148,690 | 9/1964 | Petersen | 137/317 |
| 3,395,957 | 8/1968 | Peele | 312/1 |

*Primary Examiner*—Martin P. Schwadron
*Assistant Examiner*—G. L. Walton
*Attorney, Agent, or Firm*—Blanchard, Flynn, Thiel, Boutell & Tanis

[57] ABSTRACT

A sanitary pressure relief device which includes a rigid sleeve having an annular resilient collar secured to one end thereof, as by a ring clamp. This resilient collar is adapted to be clampingly and sealingly engaged around the end of a cleanout fitting, as by a further ring clamp. An elongated resilient glove is clampingly and sealingly engaged to the other end of the sleeve, as by a further ring clamp, which glove permits removal of a screw plug from the cleanout fitting. The sleeve has a discharge opening formed in the sidewall thereof, and a length of hose is connected to this discharge opening. A suitable valve or clamp is associated with the hose for opening and closing same, to permit the controlled discharge of liquid from a drain pipe.

5 Claims, 2 Drawing Figures

SANITARY PRESSURE RELIEF DEVICE

FIELD OF THE INVENTION

This invention relates to a pressure relief device adapted to be attached to a conventional sanitary pipe for permitting the water trapped within the pipe to be discharged and disposed of without danger of the water gushing from the pipe into the surrounding room or environment, whereupon the pipe can then be cleaned by an auger or other cleanout tool.

BACKGROUND OF THE INVENTION

It is well known that sometimes the soil or sewer pipes in a building become clogged to such an extent that the foul water will not flow through the pipes. Often the water stands in the vertical sewer pipe which leads up from the usual Y-shaped cleanout fitting which connects the sewer and soil pipes. A cleanout tool, such as an auger, is inserted through one branch of the cleanout fitting into the pipe in order to dislodge the mass collected therein. In ordinary practice, this branch of the cleanout fitting is closed by a screw plug which must be removed to permit the cleanout tool to be inserted into the pipe. When the level of the water in the pipes is higher than the cleanout fitting, the water gushes out through the opened branch of the fitting, causing a great deal of annoyance and sometimes considerable damage.

To overcome the above problem, there is known a sanitary pipe cleanout device which, as shown in U.S. Pat. No. 2,451,051, is attachable to the Y-shaped cleanout fitting for permitting the controlled discharge of foul water from a clogged sewer or soil pipe. This known device, however, has only limited usability since it requires that a special adapter be substituted for the conventional screw plug, which adapter then permits attachment of a pipe cleanout device thereto. However, this adapter has to be mounted on the cleanout fitting during initial installation of the sewer pipe, so that this known device is substantially impractical from the standpoint of universal use. This known device is also structurally and operationally complex, in that it requires an elongated operating rod for removing the special screw plug, which also makes use of the device difficult and time consuming.

There is also known a device adapted for attachment to a Y-shaped or T-shaped fitting associated with a gas line to permit changing of a gas meter. This device, as shown in U.S. Pat. No. 3,148,690, utilizes a flexible sleeve which is sealed to one branch of the fitting. This flexible sleeve has an elongated pipe-like plug associated therewith for insertion into the end of the fitting after removal of the plug so as to permit bypass of the gas through the fitting, and hence removal of the gas meter. While the device of this patent is suitable for use with a gas line, it is designed specifically to permit the bypass of the gas through an alternate branch of the fitting, and hence closing off the branch of the fitting which is connected to the meter. This device is thus designed solely for use in a specialized application, and is totally unsuitable for use with sewer or drain lines. Further, the device of this patent is totally unsatisfactory for use with a drain line containing trapped water therein, since this device is not designed for use with a liquid, nor would this device accommodate a drain auger or other conventional cleanout tool.

Accordingly, it is an object of the present invention to provide an improved pressure relief device which is adapted to be attached to a conventional Y-shaped or T-shaped cleanout fitting as associated with a sewer or drain line, which apparatus permits the screw plug associated with the fitting to be removed, following which the trapped water can be discharged in a controlled manner, whereby the drain or sewer pipe can then have a suitable cleanout tool inserted therein for removing the mass of material plugging the pipe.

A further object of this invention is to provide an improved pressure release device, as aforesaid, which is adapted for attachment to drain pipes of different sizes without requiring any special adapters of the like.

Still a further object of the invention is to provide a device, as aforesaid, having the strength and rigidity sufficient to handle the liquids trapped within the pipe so that these liquids can be efficiently discharged in a controlled and confined manner, thereby preventing the uncontrolled discharge of these liquids and the undesirable damage and mess which often occurs without utilization of this device.

Another object of this invention is to provide a pressure relief device, as aforesaid, which can remain attached to the cleanout fitting after the trapped liquid has been relieved or removed, which device functions as a guide for the cleanout tool or auger as it is inserted into the drain pipe, whereby damage to the threaded end of the cleanout fitting is hence avoided.

A further object is to provice a device, as aforesaid, which can be manufactured economically, can be utilized in an easy and efficient manner, and is durable in operation.

Other objects and purposes of the invention will be apparent to persons familiar with the problem being solved by the present invention after reading the following specification and inspecting the accompanying drawings.

Figures 1, 2:
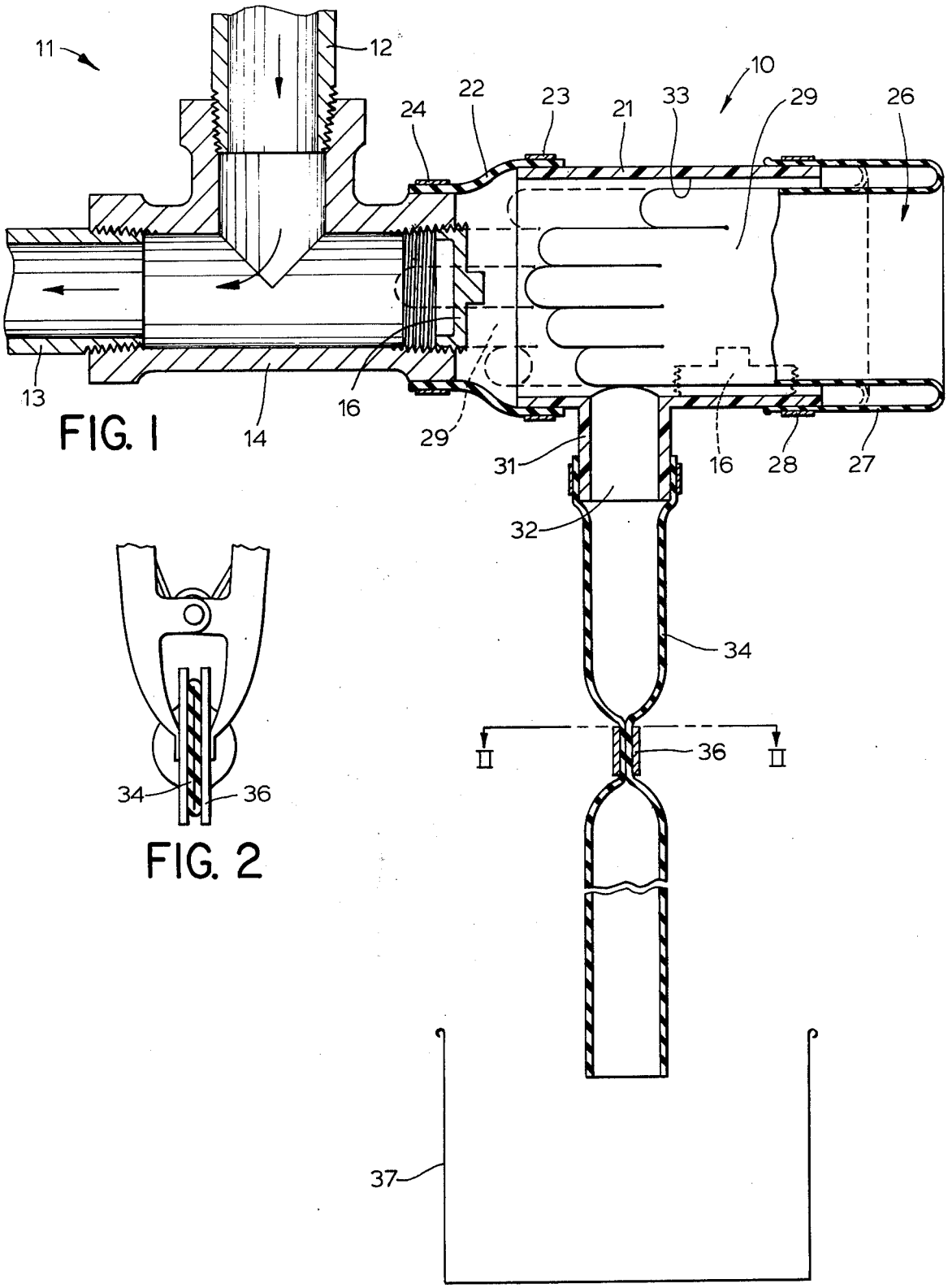
FIG. 1 is a central sectional view illustrating the device of the present invention and its utilization with a conventional cleanout fitting.
FIG. 2 is a sectional view taken along line II—II in FIG. 1.

Certain terminology will be used in the following description for convenience in reference only and will not be limiting. For example, the words "upwardly", "downwardly". "leftwardly", and "rightwardly" will refer to directions in the drawing to which reference is made. The words "inwardly" and "outwardly" will refer to directions toward and away from, respectively, the geometric center of the apparatus and designated parts thereof. Said terminology will include the words specifically mentioned, derivatives thereof, and words of similar import.

SUMMARY OF THE INVENTION

The objects and purposes of the present invention, including those mentioned above, have been met by a device which includes a rigid sleeve having an annular resilient collar secured to one end thereof, as by a ring clamp. This resilient collar is adapted to be clampingly and sealingly engaged around the end of a Y-shaped or T-shaped cleanout fitting, as by a further ring clamp. An elongated resilient glove is clampingly engaged to the other end of the sleeve, as by a further ring clamp. The sleeve has a discharge opening formed in the sidewall thereof, and a length of hose is connected to this discharge opening. A suitable valve or clamp is associated with the hose to permit opening and closing of same.

In use of this device, the screw plug associated with the cleanout fitting is initially loosened, but not totally removed. The resilient collar is slipped over the cleanout fitting and is sealed thereto by the ring clamp. A hand is then inserted into the glove, and the glove is extended internally through the sleeve so as to permit manual gripping of the plug, whereupon the plug is rotated so as to remove same from the connector. The plug is then moved into the rearward end of the sleeve, so that the discharge opening is in open communication with the drain or soil pipes which are joined to the cleanout fitting. The trapped water and waste in the drain pipes can then flow into the sleeve and through the discharge opening into the hose. By suitably opening and closing the clamp or valve associated with the hose, the trapped water can be discharged into a receptacle or bucket for disposal. After the pressurized liquid has been removed from the drain system, the glove can be removed from the sleeve and an auger or other cleanout tool inserted through the sleeve into the drain pipe for cleaning thereof.

DETAILED DESCRIPTION

Referring to the drawings, there is illustrated a pressure relief device 10 adapted for use with a sewer or drain system 11. Such system typically includes a vertical or upwardly projecting drain pipe 12 connected to a substantially horizontally extending soil or drain pipe 13 by means of an intermediate cleanout fitting 14 which is conventionally of a Y-shaped or T-shaped configuration. One leg of the fitting 14 has a conventional screw plug 16 threaded thereto for closing off the fitting, which screw plug is removed to permit cleaning of the drain pipe.

The apparatus 10 includes a rigid body member 21 formed as a sleeve which is open at opposite ends thereof. A resilient collar 22 is associated with the forward end of the sleeve 21 to permit the apparatus 10 to be sealingly clamped to the fitting 14. This collar 22 comprises a sleeve-like member constructed of a flexible elastic material, such as rubber or other suitable elastomeric material. One end of the collar 22 sealingly surrounds the forward end of the sleeve 21 and is sealingly and fixedly clamped thereto, as by a conventional ring clamp 23. The other end of the collar (the leftward end in FIG. 1) is adapted to be positioned in surrounding relationship to the annular flange formed on the fitting 14 and fixedly and sealingly engaged therewith, as by a further ring clamp 24.

The sleeve 21 is preferably of an internal diameter at least slightly larger than the external diameter of the fitting 14 so as to permit a human hand to readily pass through the sleeve. For this reason, the resilient clamping collar 18 is preferably fabricated of a tapered or conical shape so that the rearward end thereof is preferably of larger diameter than the forward end thereof, whereby these ends will thus elastically expand and sealingly engage the sleeve and the drain fitting.

The rearward end of the sleeve 21 (the rightward end in FIG. 1) has an elongated flexible boot 26 secured thereto. This boot includes an elongated sleeve-like portion 27 which has the free end thereof disposed in surrounding relationship to the adjacent end of the sleeve 21, being fixedly and sealingly clamped thereto by a conventional clamping ring 28. The elongated sleeve portion 27 of the boot terminates in a flexible glove 29 which is integral with the sleeve portion 27. The glove portion 29 is normally positioned within the sleeve portion 27 and can be axially inserted into and through the rigid sleeve 21 so as to permit gripping of the screw plug 16. This axial displacement of the glove portion 29 through the sleeve 21 is permitted due to the rolling action of the sleeve portion 27. The boot 26, like the annular coller 22, is preferably constructed of a flexible elastic material, such as rubber or plastic.

The rigid sleeve 21 has a small projection or nipple 31 formed integrally therewith and projecting outwardly from the sidewall of the sleeve, which nipple 31 defines a discharge opening 32 which communicates with the chamber 33 defined within the interior of the sleeve 21. This nipple 31 is in turn connected to a suitable discharge conduit 34 which, in the illustrated embodiment, comprises an elongated flexible hose of rubber, plastic or the like. This hose 34 has a suitable flow control device 36 associated therewith, which device may be formed either as a valve or a clamping device which performs the same function as a valve. In the illustrated embodiment, this flow-control device 36, comprises a scissor-type spring clamp which suitably engages the hose for closing same, thereby preventing flow therethrough. This clamp, when manually released, permits opening of the hose so that water can flow therethrough and externally discharge, such as into a suitable bucket or receptacle 37.

OPERATION

The operation of the device according to the present invention will be briefly described to insure a proper understanding thereof.

When it is desired to clean the drain system 11, such as due to a stoppage in the pipe 13 causing water to back up in both pipes 12 and 13, it is necessary to remove the screw plug 16 and then insert a suitable cleaning tool, such as a rotatable auger, into the pipe 13 so as to dislodge the stoppage of solid mass.

According to the present invention, prior to initiating a cleaning operation, the screw plug 16 is initially loosened as by means of a pipe wrench, although the screw plug is not completely removed from the fitting 14. Following loosening of the plug, the device 10 is attached to the cleanout fitting 14 by positioning the forward (leftward) end of the resilient collar 22 in surrounding relationship to the end of the fitting having the plug therein. This positioning of the collar 22 around the fitting normally requires that the collar be elastically stretched so as to be positionable around the fitting, following which the elasticity of the collar causes it to shrink into snug engagement with the flange formed on the cleanout fitting. Thereafter, the annular clamping ring 24 is securely tightened so as to fixedly and sealingly hold the resilient collar 22 in engagement with the fitting 14.

Prior to removal of the plug 16, the clamp or valve 36 is engaged with the hose 34 so as to close same. Thereafter, a hand is inserted into the glove portion 29 and same is inserted through the rigid sleeve 21, whereby the screw plug 16 can be manually gripped and suitably rotated so as to totally disconnect same from the cleanout fitting 14. The screw plug 16, as gripped through the glove portion 29, can then be retracted axially into the rigid sleeve 21 and deposited in the rearward end of the sleeve, substantially as illustrated by dotted lines in FIG. 1. This removal of the plug permits the water trapped within the pipes 12 and 13 to flow into the chamber 33 defined within the sleeve 21, although flow through the hose 34 is prevented due to the closure thereof by the control device 36. By suitably opening the control device 36 so as to open the hose 34, a controlled amount of the trapped liquid can be discharged into the receptacle 37.

By repetitively filling and emptying the receptacle 37, by suitably opening and closing the clamping device 36, the liquid trapped within the pipes 12 and 13 can be suitably disposed of in a controlled manner without permitting this liquid to escape into the surrounding environment. Rather than using the receptacle, the hose 34 can be suitably discharged directly into any other suitable drain, if available.

After the liquid has been discharged from the sewer system 12, then the boot 26 can be disconnected from the rigid sleeve 21 by loosening the clamping ring 27, thereby uncovering or opening the rearward (rightward) end of the sleeve 21. A suitable cleanout tool, such as an elongated rotatable auger, can then be inserted through the sleeve 21 directly into the pipe 12 so as to permit cleaning thereof. Maintaining the sleeve 21 connected to the fitting 14 during the cleaning operation is highly desireable since the outer or rearward free end of the sleeve 21 thus acts as a guide edge over which the auger rubs when it is being inserted into the pipe, inasmuch as the auger normally rests on the floor and is then pulled upwardly and bent inwardly so as to pass into the pipe. The sleeve thus more readily accommodates the flexing of the auger as it is bent into a horizontal position for insertion into the pipe, thereby preventing the auger from rubbing over the threaded edge of the fitting 14, and thereby greatly facilitating the slidable guided movement of the auger into the pipe.

The device of the present invention can also be totally disconnected from the fitting 14 prior to insertion of the auger, if desired. When used in this manner, the clamping ring 24 is loosened to permit the forward end of the collar 22 to be removed from the fitting 14, thereby enabling the complete device 10 to be disconnected from the drain system. When used in this manner, there is thus no need to disconnect the boot 26 from the sleeve 21. However, when an elongated flexible auger is being used for cleaning the pipe 12, then it is preferable to maintain the sleeve 21 connected to the fitting 14 so as to more properly guide the auger and prevent unnecessary wear of the threads located at the end of the fitting, as explained above.

Regarding the releasable clamping rings 23, 24 and 28, these rings may assume any conventional configuration, such as split rings employing a screw-type clamping member. In the alternative, they may be split rings employing a toggle-type device for clamping or releasing the ring. Many conventional clamping rings of this general type are known, so that further detailed description thereof is not believed necessary.

In some instances, the threaded cleanout plug 16 becomes sufficiently corroded and fouled that it is impossible to threadably remove this plug, even utilizing a pipe wrench. In this instance, the device of the present invention can still be advantageously utilized since the complete apparatus can be mounted on the cleanout fitting in surrounding relationship to the plug, and the flexible glove can then be removed. A chisel or other suitable tool can then be inserted through the rigid sleeve and utilized for breaking or puncturing the plug. As soon as the plug is punctured, some of the pressure fluid trapped within the drain system will obviously escape. However, the flexible glove can be immediately repositioned on and sealingly clamped to the rigid sleeve, thereby preventing the escape of any substantial quantities of the trapped fluid, following which the trapped fluid can be removed through utilization of the device in the same manner as explained above. After the pressure of the trapped fluid has been relieved, then the glove can then again be removed and the plug completely broken away so as to permit cleaning of the drain pipe.

Although a particular preferred embodiment of the invention has been disclosed in detail for illustrative purposes, it will be recognized that variations or modifications of the disclosed device, including the rearrangement of parts, lie within the scope of the present invention.

The embodiments of the invention in which an exclusive property or privilege is claimed are as follows:

1. In a pressure relief device for attachment to a drain cleanout fitting having a removable plug for permitting controlled discharge of liquid from a drain system, the improvement wherein said pressure relief device comprises:

a rigid sleeve defining therein a chamber and having first and second openings formed in the opposite axial ends thereof for communication with said chamber;

releasable annular seal means for creating a sealed fluid-tight engagement with said fitting in surrounding relationship to the removable plug, said seal means including an axially elongated seal sleeve of flexible rubberlike material having one end thereof connected to and sealingly engaged with said body in surrounding relationship to said first opening, said seal sleeve having the other end thereof sealingly connectible to said fitting;

discharge conduit means connected to said rigid sleeve and communicating with said chamber for permitting discharge of liquid therefrom, said conduit means being fixed to the peripheral sidewall of said rigid sleeve intermediate the ends thereof;

manually operable flow control means connected to said discharge conduit means for selectively opening and closing same;

flexible boot means fixedly connected to said rigid sleeve in surrounding relationship to said second opening for sealingly closing same, said boot means including an elongated flexible glove portion which is insertable into and through said rigid sleeve for permitting engagement with the plug and removal thereof from the fitting;

said boot means also including a flexible sleeve portion integrally connected to said flexible glove portion, said sleeve portion being engaged with said rigid sleeve in surrounding relationship to said second opening; and releasable clamping means coacting with said sleeve portion and said rigid sleeve for holding said sleeve portion in clamped and sealed engagement with said rigid sleeve, said clamping means being releasable to permit removal of said boot means from said rigid sleeve.

2. A device according to claim 1, including releasable annular ringlike clamping means coacting with said other end of said seal sleeve for holding said seal sleeve in clamped and sealed engagement with said rigid sleeve in surrounding relationship to said first opening, said last-mentioned clamping means being releasable to permit removal of said seal sleeve from said rigid sleeve.

3. A device according to claim 2, wherein a further releasable annular ringlike clamping means is associated with said one end of said seal sleeve for sealingly but releasably clamping said seal sleeve to the fitting in surrounding relationship to the removable plug.

4. A device according to claim 1, wherein said seal sleeve is elastically stretchable so as to be sufficiently stretched to thereby fit around said fitting in snug sealed engagement therewith.

5. A device according to claim 1, wherein said flow control means includes an elongated flexible hose connected to said discharge conduit means, and manually operable clamp means engageable with said hose for permitting collapsing of said hose to thereby close same.

* * * * *